United States Patent [19]

Schwind

[11] 4,203,351

[45] May 20, 1980

[54] FLUID MOTOR ACTUATOR FOR ROTATING A SHAFT BACK AND FORTH

[75] Inventor: Heinz G. Schwind, Hengelo, Netherlands

[73] Assignee: Griesel B.V., Hengelo, Netherlands

[21] Appl. No.: 877,717

[22] Filed: Feb. 14, 1978

[51] Int. Cl.[2] ..... F01B 7/02

[52] U.S. Cl. ..... 92/69 R; 92/136; 92/150; 251/58

[58] Field of Search ..... 92/50, 69 R, 69 A, 69 B, 92/75, 138, 150, 151, 237, 136; 251/58

[56] References Cited

U.S. PATENT DOCUMENTS

| | | | |
|---|---|---|---|
| 2,125,938 | 8/1938 | Long | 92/237 |
| 3,274,895 | 9/1966 | Hendrickson | 92/138 |
| 3,307,456 | 3/1967 | Etienne | 92/237 |
| 3,398,762 | 8/1968 | Fredd | 251/58 |
| 3,982,725 | 9/1976 | Clark | 251/58 |

FOREIGN PATENT DOCUMENTS

| | | | |
|---|---|---|---|
| 2279963 | 12/1969 | France | 92/138 |

*Primary Examiner*—Abraham Hershkovitz
*Attorney, Agent, or Firm*—John P. Snyder

[57] ABSTRACT

Fluid motor actuator having two pistons reversely movable in a common cylinder, the pistons each carrying at least three extensions on their proximal sides, one of which being provided with a rack camming with one common spur gear fastened on a transverse shaft projecting from the cylinder, the extensions with their outer surfaces lying in one common cylindrical outer surface.

6 Claims, 4 Drawing Figures

FIG.1
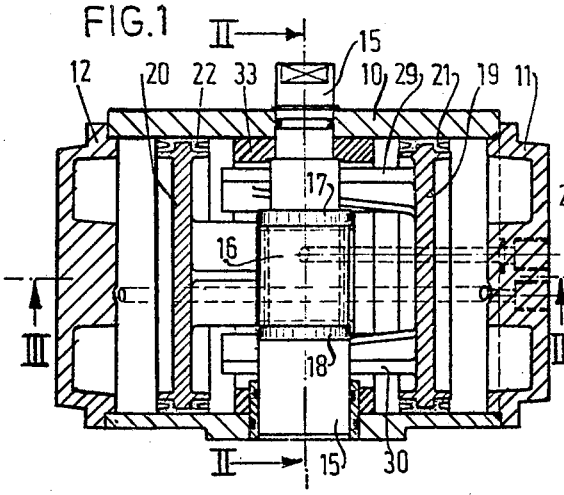
FIG.2
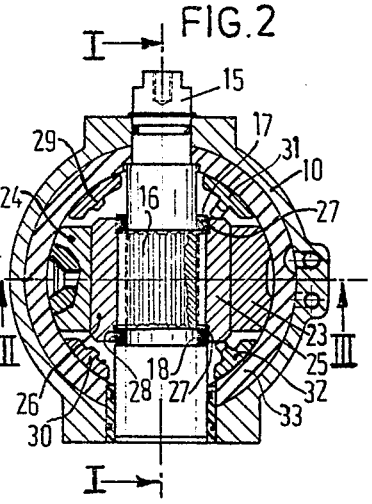
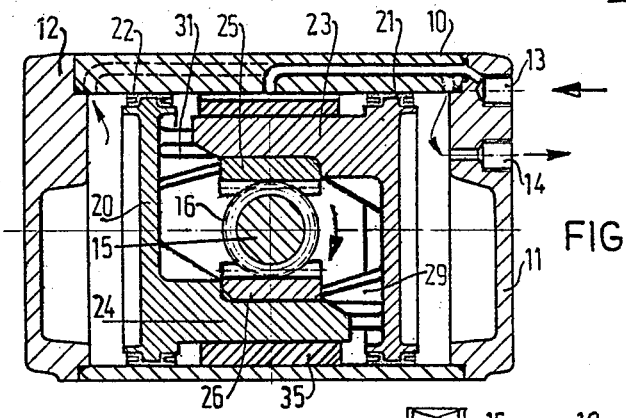
FIG.3
FIG.4
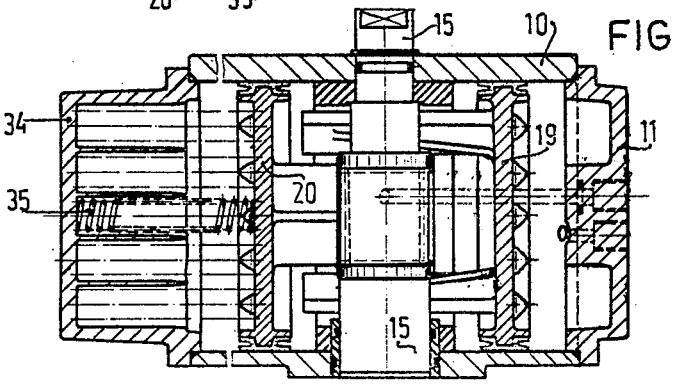

FLUID MOTOR ACTUATOR FOR ROTATING A SHAFT BACK AND FORTH

The invention relates to a fluid motor actuator for rotating a shaft back and forth, comprising a cylinder in which two pistons provided with extensions facing one another and carrying racks are movable towards and away from one another, said racks facing one another and engaging a common spur gear on a transverse shaft projecting from the cylinder.

Fluid motor actuators of this general type are old and known such as from Dutch patent application 67 03302 published Sept. 6, 1967. In this publication the disadvantage has been disclosed already that the pistons tend to get out of true or to turn so that the pistons may be jammed or the seal may become faulty due to irregular wear of the cylinder. In order to obviate these disadvantages it has been proposed to provide a bore in the pistons through which an elongated guide member, which is fixedly arranged in the cylinder extends, along which the pistons are slidably guided. A drawback of this construction is that an additional seal has to be provided in said bores, increasing the risk of leakage while requiring additional machining in said bores.

A principal object of the invention is to provide a simpler solution for said problem. To that end the pistons each are provided with at least two auxiliary extensions describing together with the former extensions carrying the racks one common cylindrical outer face.

In this way a reliable guiding is obtained, whilst machining of the outer face of the extensions is very simple. If the cylindrical outer face is concentric with the outer face of the piston, said machining can be carried out without releasing the workpiece from the bench so that this embodiment is preferred.

In order to obtain a simple and readily replaceable guide for the extensions and the auxiliary extensions, the extensions are preferably slidable in a ring of synthetic resin common to both pistons. The material selected for said ring has, of course, a low friction coefficient on the material of the extensions and has preferable self lubricating properties.

In order to minimize tilting of the pistons and to ensure that only forces in axial direction to the cylinder have to be transferred by the racks on the spur gear the extension preferably on either side of the racks provided with flat guide paths, which are being displaceable along corresponding surfaces of revolution about the transverse shaft on either side of the spur gear.

The invention will be further illustrated in the following specification while referring to the drawings showing some preferred embodiments.

FIG. 1 is an axial sectional view of a fluid motor actuator according to the invention.

FIG. 2 is a cross-sectional view taken on the line II—II in FIG. 1.

FIG. 3 is an axial sectional view taken on the line III—III in FIG. 1.

FIG. 4 is an axial sectional view showing a modified embodiment of the fluid motor actuator according to the invention.

FIGS. 1 to 3 illustrate a pneumatically or hydraulically actuable device for rotatably driving back and forth, for example, butterfly valves, plug and ball cocks. The device comprises a cylinder 10 having two end walls 11, 12, in one of which two tapped bores 13, 14 being provided for supplying and discharging the driving fluid.

Approximately midway the cylinder 10 a transverse shaft 15 is rotatably journalled, carrying a spur gear 16 rigidly secured thereto. On either side of said spur gear cylindrical rings 17, 18 on the shaft 15. One end of the transverse shaft 15 is projecting from the cylinder 10 and is at this place provided with coupling members such as one or more flattened faces for connection with a device to be actuated.

On either side of the shaft 15 pistons 19, 20 are slidable in the cylinder towards and away from one another under the action of driving fluid supplied through the bore 14 and 13 respectively. The pistons are in sealing relationship with the cylinder wall by means of suitable sealing rings 21 and 22.

Each piston 19, 20 is provided with an extension 23, 24 carrying a rack 25, 26. These racks each are in engagement with opposite sides of the spur gear. On either side of the racks flat guide paths 27, 28 are provided, bearing on and being displaceable along the rings 17, 18 on either side of the spur gear 16.

The pistons are each provided, in addition, on their proximal sides with two auxiliary extensions 29, 30 and 31, 32, whose outer surfaces together with those of the extensions 23, 24 are at about equal circumfential distances from a common center (FIG. 2) and are lying in common cylindrical surface being concentric with the outer surfaces of the pistons 19, 20. These outer faces of the extensions and of the auxiliary extensions are guided in a common ring 33, which bears on the cylinder wall in the area of the transverse shaft 15. With regard to friction coefficient and resistance to lubricants and driving fluids the material of said ring may consist of organosilicon resins and polyhalogen alkenes such as "ptfe".

FIG. 4 shows a slightly modified embodiment. The end wall designated by 12 in FIG. 1 has in this case recesses accommodating compression springs 35 for moving the piston 20 and hence the piston 19 wholly or partly back so that, for example, in the event of disturbances resulting in failing of the fluid pressure, the actuated device will always be in a given, desired position.

From the foregoing will be apparent that very simple and reliable means are provided for accomplishing the objects of the invention. It is to be understood that the invention is not limited to the specific constructions shown and described herein as various modifications can be made therein within the spirit of the invention and the scope of the appended claims.

What is claimed is:

1. A fluid motor actuator for rotating a shaft back and forth, comprising a cylinder in which two pistons provided with extensions facing one another and carrying racks are movable towards and away from one another, said racks facing one another and engaging a common spur gear on a transverse shaft projecting from the cylinder, said pistons each being provided with at least two auxiliary extensions, describing together with the former extensions carrying the racks one common cylindrical outer surface, and said extensions and auxiliary extensions of one piston and those of the other piston are alternating.

2. A fluid motor actuator as defined by claim 1, in which the cylindrical outer surface and the cylindrical outer surfaces of the pistons have a common center.

3. A fluid motor actuator as defined by claim 2, the extensions of both pistons being slidably guided in one common guiding ring being supported in the cylinder.

4. A fluid motor actuator as defined by claim 3, the guiding ring consisting of synthetic resin having low friction properties.

5. A fluid motor actuator as defined by claim 1, the extensions carrying the racks on either side of said racks being provided with flat, axial guide surfaces bearing on and being displaced along corresponding surfaces of revolution about the transverse shaft on either side of the spur gear.

6. A fluid motor actuator as defined by claim 1, characterized in that the extension and auxiliary extensions of each piston are at about equal circumferential distances.

* * * * *